US011247357B2

(12) United States Patent
Broemse

(10) Patent No.: US 11,247,357 B2
(45) Date of Patent: Feb. 15, 2022

(54) HEATING DELIVERY ELEMENT FOR A SHAVING RAZOR

(71) Applicant: The Gillette Company LLC, Boston, MA (US)

(72) Inventor: Norbert Broemse, Bad Homburg (DE)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/984,901

(22) Filed: Aug. 4, 2020

(65) Prior Publication Data

US 2020/0361106 A1 Nov. 19, 2020

Related U.S. Application Data

(63) Continuation of application No. 15/866,596, filed on Jan. 10, 2018, now Pat. No. 10,766,155.

(30) Foreign Application Priority Data

Jan. 20, 2017 (EP) ..... 17152536

(51) Int. Cl.
*B26B 21/48* (2006.01)
*B26B 21/40* (2006.01)
*H05B 3/36* (2006.01)

(52) U.S. Cl.
CPC ..... *B26B 21/48* (2013.01); *B26B 21/4056* (2013.01); *H05B 3/36* (2013.01)

(58) Field of Classification Search
CPC ..... B26B 21/48; B26B 21/4056; H05B 3/36
USPC ..... 219/531
See application file for complete search history.

(56) References Cited

U.S. PATENT DOCUMENTS

| | | | |
|---|---|---|---|
| 1,505,578 | A | 8/1924 | Barra |
| 1,552,026 | A | 9/1925 | Barra |
| 1,821,574 | A | 9/1931 | Nicholas |
| 1,892,836 | A | 1/1933 | Harvey |
| 2,018,147 | A | 10/1935 | Pirwitz |
| 2,063,808 | A | 12/1936 | Henderson et al. |
| 2,164,581 | A | 7/1939 | Ewald |
| 2,225,257 | A | 12/1940 | Conill |

(Continued)

FOREIGN PATENT DOCUMENTS

| | | | |
|---|---|---|---|
| AU | 654696 | B2 | 11/1994 |
| CN | 101306537 | A | 11/2008 |

(Continued)

OTHER PUBLICATIONS

EPO Search Report in corresponding EPO application 17152536.3 dated Jul. 7, 2017.

(Continued)

*Primary Examiner* — Vishal Pancholi
(74) *Attorney, Agent, or Firm* — John M. Lipchitz

(57) ABSTRACT

A heat delivery element for a shaving razor with a face plate having a skin contacting surface and an opposing inner surface. A heater having a heater track is positioned between an upper dielectric layer and a lower dielectric layer. A heat dispersion layer having a lower surface directly contacts the inner surface of the face plate. An upper surface of the heat dispersion layer directly contacts the lower dielectric layer of the heater. The heat dispersion layer has graphite foil compressed by 20% to 50% of an original thickness.

14 Claims, 4 Drawing Sheets

(56) References Cited

U.S. PATENT DOCUMENTS 2,231,219 A 2/1941 Peterson
2,324,148 A 7/1943 Gravin
2,327,192 A 8/1943 Keene
2,414,482 A 1/1947 Kelso
2,536,844 A 1/1951 Carlton et al.
2,622,319 A 12/1952 Russell
2,714,651 A 8/1955 Wotton
3,325,627 A 6/1967 Adler et al.
3,364,568 A 1/1968 Lowy
3,454,745 A 7/1969 Stone
3,591,923 A 7/1971 Rose
3,611,568 A 10/1971 Alexander et al.
3,648,368 A 3/1972 Douglass et al.
3,795,979 A 3/1974 Perry
3,876,858 A 4/1975 Davis et al.
3,896,364 A 7/1975 Reister
3,934,115 A 1/1976 Peterson
4,077,119 A 3/1978 Sellera
4,148,236 A 4/1979 Holoyen et al.
4,253,013 A 2/1981 Mabuchi
4,266,340 A 5/1981 Bowman
4,377,034 A 3/1983 Druash et al.
4,403,414 A 9/1983 Kiraly et al.
4,514,904 A 5/1985 Bond
4,587,968 A 5/1986 Price
4,598,192 A 7/1986 Garrett
4,658,505 A 4/1987 Williams
4,716,652 A 1/1988 Cataudella
4,797,998 A 1/1989 Motta
4,809,432 A 3/1989 Schauble
4,837,930 A 6/1989 Righi
4,864,735 A 9/1989 Chung
4,879,811 A 11/1989 Cooney
4,918,818 A 4/1990 Hsieh
5,010,905 A 4/1991 Snyder et al.
5,016,352 A 5/1991 Metcalf
5,029,391 A 7/1991 Althaus et al.
5,044,077 A 9/1991 Ferraro et al.
5,046,249 A 9/1991 Kawara et al.
5,065,515 A 11/1991 Iderosa
5,098,414 A 3/1992 Walker
5,113,585 A 5/1992 Rogers
5,121,541 A 6/1992 Patrakis
5,157,834 A 10/1992 Chen et al.
5,191,172 A 3/1993 Garganese
5,191,712 A 3/1993 Crook et al.
5,270,493 A 12/1993 Inobe et al.
5,299,354 A 4/1994 Metcalf et al.
5,309,640 A 5/1994 Caron
5,333,382 A 8/1994 Buchbinder
5,337,478 A 8/1994 Cohen et al.
5,347,717 A 9/1994 Ts
5,394,777 A 3/1995 Kozikowski
5,402,573 A 4/1995 Laniado
5,454,164 A 10/1995 Yin et al.
5,600,887 A 2/1997 Olson
5,653,025 A 8/1997 Cheng et al.
5,743,017 A 4/1998 Dreher et al.
5,780,819 A 7/1998 Fabrikant et al.
5,782,346 A 7/1998 Gray et al.
5,786,573 A 7/1998 Fabrikant et al.
5,787,586 A 8/1998 Apprille, Jr. et al.
5,794,342 A 8/1998 Davey
5,794,343 A 8/1998 Lee et al.
5,933,960 A 8/1999 Avidor
5,953,825 A 9/1999 Christman et al.
6,061,912 A 5/2000 Gazaway
6,115,924 A 9/2000 Oldroyd
6,158,125 A 12/2000 Dolev
6,161,287 A 12/2000 Swanson et al.
6,301,792 B1 10/2001 Speer
6,421,918 B1 7/2002 Dato et al.
6,430,813 B2 8/2002 Muraguchi et al.
6,481,104 B1 11/2002 Parker et al.
6,574,866 B2 6/2003 Pragt et al.
6,736,997 B2 5/2004 Olding et al.
6,763,590 B2 7/2004 Guimont et al.
6,789,321 B2 9/2004 Simms
6,817,101 B1 11/2004 Bohmer
6,836,966 B2 * 1/2005 Patrick ..... B26B 19/382 30/140
6,868,610 B2 3/2005 Brandt et al.
6,910,274 B1 6/2005 Pennella et al.
6,946,624 B1 9/2005 Tomassetti
7,111,400 B2 9/2006 Guimont et al.
7,137,203 B2 11/2006 Bressler et al.
7,197,825 B2 4/2007 Walker et al.
7,520,408 B1 4/2009 Smith et al.
7,681,320 B2 3/2010 Szczepanowski et al.
7,743,506 B2 6/2010 Szczepanowski et al.
7,770,294 B2 8/2010 Bruno et al.
8,015,711 B2 9/2011 Psimadas et al.
8,183,940 B2 5/2012 Koyama et al.
8,186,063 B2 5/2012 Clarke
8,479,624 B2 7/2013 Flyash et al.
8,481,898 B2 7/2013 Parker
8,510,958 B2 8/2013 Hart et al.
8,516,706 B2 8/2013 Flyash et al.
8,615,886 B1 12/2013 Childers
8,615,891 B2 12/2013 Psimadas et al.
8,713,801 B2 5/2014 Bohmer
8,745,883 B2 6/2014 Murgida et al.
8,769,825 B2 7/2014 Howell et al.
8,772,679 B2 7/2014 Novikov
8,793,879 B2 8/2014 Jessemey et al.
9,071,073 B2 6/2015 Bourilkov et al.
9,149,945 B2 * 10/2015 Tomassetti ..... B26B 21/48
9,434,080 B2 9/2016 Bozikis
9,469,039 B2 10/2016 Hodgson et al.
9,498,892 B2 11/2016 Nakasuka et al.
9,604,375 B2 3/2017 Bohmer et al.
9,623,575 B2 4/2017 Griffin et al.
9,636,830 B2 5/2017 Hodgson et al.
9,707,690 B2 7/2017 Hodgson
9,751,229 B2 9/2017 Hodgson
9,789,620 B2 10/2017 Wain et al.
9,833,917 B2 12/2017 Hodgson et al.
9,889,572 B2 2/2018 Bucco
9,993,931 B1 6/2018 Zucker
10,099,393 B2 10/2018 Gester
10,406,704 B2 9/2019 Barrett et al.
10,538,006 B2 1/2020 Bridges et al.
10,583,576 B2 3/2020 Broemse et al.
10,652,956 B2 5/2020 Heubach et al.
10,766,155 B2 9/2020 Broemse
10,773,406 B2 9/2020 Broemse
10,894,330 B2 1/2021 Goeder et al.
2001/0003869 A1 6/2001 Rocha
2001/0023538 A1 9/2001 Muraguchi et al.
2002/0096512 A1 7/2002 Abbott et al.
2002/0120278 A1 8/2002 Cense et al.
2002/0189102 A1 12/2002 Orloff
2003/0046816 A1 * 3/2003 Kanzer ..... B26B 21/40 30/32
2003/0088984 A1 5/2003 Brandt et al.
2003/0101589 A1 6/2003 Barish
2003/0154832 A1 8/2003 Guimont et al.
2003/0155887 A1 8/2003 Bourilkov et al.
2003/0226258 A1 * 12/2003 Patrick ..... B26B 21/48 30/34.05
2003/0231001 A1 12/2003 Bruning
2004/0045948 A1 3/2004 Shalev et al.
2004/0074097 A1 4/2004 Guimont et al.
2004/0098863 A1 5/2004 Shalev et al.
2005/0189338 A1 9/2005 Sukeforth
2005/0198840 A1 9/2005 Worrick, III et al.
2005/0198841 A1 9/2005 Worrick, III
2005/0218513 A1 10/2005 Seko
2005/0268472 A1 12/2005 Bourilkov et al.
2006/0032054 A1 2/2006 Simms et al.
2006/0032055 A1 2/2006 Simms et al.
2006/0037197 A1 2/2006 Hawes et al.
2006/0070242 A1 4/2006 Szczepanowski et al.
2006/0080838 A1 4/2006 Johnson et al.

(56) References Cited

U.S. PATENT DOCUMENTS

2006/0117568 A1 6/2006 Tomassetti
2006/0123631 A1 6/2006 Szczepanowski et al.
2006/0138121 A1 6/2006 Werkman et al.
2007/0028449 A1 2/2007 King
2007/0056167 A1 3/2007 Richard et al.
2007/0084058 A1 4/2007 Szczepanowski
2007/0145031 A1 6/2007 Shalev et al.
2007/0163123 A1 7/2007 Gratsias et al.
2007/0271714 A1 11/2007 Adam et al.
2008/0016692 A1 1/2008 Noble
2008/0271319 A1 11/2008 Saker et al.
2009/0071010 A1 3/2009 Hart
2009/0119923 A1 5/2009 Hart et al.
2009/0255123 A1 10/2009 Tomassetti
2009/0313837 A1 12/2009 Winter et al.
2010/0024615 A1 2/2010 Rebaudieres et al.
2010/0031510 A1 2/2010 Gester et al.
2010/0043242 A1 2/2010 Stevens
2010/0122464 A1 5/2010 Ndou et al.
2010/0198134 A1 8/2010 Eckhouse et al.
2010/0205808 A1 8/2010 King
2010/0212939 A1 8/2010 Ito et al.
2010/0292546 A1 11/2010 Gonopolskiy et al.
2010/0319204 A1 12/2010 Peterson et al.
2011/0016721 A1 1/2011 Schnak et al.
2011/0041340 A1 2/2011 Sherman et al.
2011/0126413 A1 6/2011 Szczepanowski et al.
2011/0167640 A1* 7/2011 Flyash ..... A61B 18/1402 30/34.05
2011/0174328 A1 7/2011 Cerutti et al.
2011/0289776 A1 12/2011 Hawes et al.
2011/0314677 A1 12/2011 Meier et al.
2012/0030945 A1 2/2012 Clarke et al.
2012/0060382 A1 3/2012 Beugels et al.
2012/0096718 A1 4/2012 Howell
2012/0102761 A1 5/2012 Jessemey et al.
2012/0124840 A1 5/2012 Iaccarino
2012/0125489 A1 5/2012 Hashimura et al.
2012/0167392 A1 7/2012 Cherian et al.
2012/0205362 A1 8/2012 Etzkorn et al.
2012/0227554 A1 9/2012 Beech
2012/0233864 A1 9/2012 Flyash et al.
2012/0234658 A1 9/2012 Schnak et al.
2012/0255185 A1 10/2012 Patel et al.
2012/0255942 A1 10/2012 Vodvarka
2012/0266465 A1 10/2012 Hart et al.
2012/0279070 A1 11/2012 Seo
2012/0279073 A1 11/2012 Snow et al.
2012/0279075 A1 11/2012 Amsel
2012/0291288 A1 11/2012 Bohmer et al.
2012/0311865 A1 12/2012 Hamilton et al.
2012/0330234 A1 12/2012 Balluff et al.
2013/0081290 A1 4/2013 Murgida et al.
2013/0144280 A1 6/2013 Eckhouse et al.
2013/0145626 A1 6/2013 Xu et al.
2013/0199348 A1 8/2013 Aberizk
2013/0247395 A1 9/2013 Szczepanowski et al.
2013/0291391 A1 11/2013 Stevens
2014/0026423 A1 1/2014 Schnak et al.
2014/0048310 A1 2/2014 Montevirgen et al.
2014/0096396 A1 4/2014 Pauw
2014/0114301 A1 4/2014 Solomon et al.
2014/0245611 A1* 9/2014 Bohmer ..... B26B 21/48 30/34.05
2015/0032128 A1 1/2015 Tavlin et al.
2015/0068043 A1 3/2015 Gester et al.
2015/0122899 A1 5/2015 Kaneko et al.
2015/0135538 A1 5/2015 Tomassetti et al.
2015/0174773 A1 6/2015 Hodgson
2015/0174774 A1 6/2015 Hodgson
2015/0174776 A1* 6/2015 Hawes ..... B26B 21/4075 30/526
2015/0197018 A1 7/2015 Heubach et al.
2015/0197019 A1* 7/2015 Hodgson ..... B26B 21/48 30/34.05
2015/0197020 A1 7/2015 Hodgson et al.
2015/0197021 A1* 7/2015 Hodgson ..... B26B 21/165 30/34.05
2015/0266190 A1 9/2015 Bohmer et al.
2015/0296622 A1 10/2015 Jiang et al.
2015/0298326 A1 10/2015 Tomassetti et al.
2015/0298327 A1* 10/2015 Tomassetti ..... B26B 21/48 30/34.05
2015/0321366 A1 11/2015 Papadopoulos-papageorgis et al.
2016/0046028 A1 2/2016 Meier et al.
2016/0096280 A1 4/2016 Robertson
2016/0121496 A1 5/2016 Johnson
2016/0121497 A1 5/2016 Johnson
2016/0375596 A1 12/2016 Broemse et al.
2016/0375597 A1 12/2016 Broemse
2017/0021513 A1 1/2017 Liberatore
2017/0066148 A1 3/2017 Hodgson et al.
2017/0066149 A1 3/2017 Hodgson et al.
2017/0112002 A1 4/2017 Behrendt
2017/0173806 A1 6/2017 Lee
2017/0203453 A1 7/2017 Hodgson et al.
2017/0225345 A1 8/2017 Burrowes et al.
2017/0282390 A1 10/2017 Hodgson
2017/0282392 A1 10/2017 Maimone et al.
2017/0319310 A1 11/2017 Gengyo et al.
2017/0326743 A1 11/2017 Hodgson
2019/0117356 A1 4/2019 Bärtschi et al.
2019/0299465 A1 10/2019 Gester et al.
2019/0299471 A1 10/2019 Verasamy et al.
2019/0299473 A1 10/2019 Johnson et al.
2019/0358837 A1 11/2019 Broemse et al.
2020/0236738 A1 7/2020 Heubach et al.

FOREIGN PATENT DOCUMENTS

CN 201253863 Y 6/2009
CN 103208780 A 7/2013
CN 103235614 A 8/2013
DE 575523 C 4/1933
DE 2801845 A1 7/1979
DE 202009003889 U1 5/2009
DE 102008032389 A1 1/2010
EP 0020816 A1 1/1981
EP 0885697 A1 12/1998
EP 1535708 A1 6/2005
EP 1363517 B1 2/2008
EP 2338652 A1 6/2011
EP 3166760 B1 3/2018
FR 520234 A 6/1921
FR 749861 A 8/1933
FR 840502 A 4/1939
FR 985030 A 7/1951
FR 2703290 A1 10/1994
FR 2716402 A1 8/1995
GB 541723 A 12/1941
GB 1075139 A 7/1967
GB 2323224 A 9/1998
GB 2452411 B 5/2010
JP S5416091 U 2/1979
JP S5566396 U 5/1980
JP S56128188 A 10/1981
JP S60194333 U 12/1985
JP H06137960 A 5/1994
JP H06216532 A 8/1994
JP H08202459 A 8/1996
JP H10165521 A 6/1998
JP H10207288 A 8/1998
JP H11059591 3/1999
JP 3066524 B2 5/2000
JP 2002023805 A 1/2002
JP 2002066172 A 3/2002
JP 2004186072 A 7/2004
JP 2008059842 A 3/2008
JP 2008063187 A 3/2008
JP 5753310 B1 5/2015
KR 20070089345 A 8/2007
KR 20100108753 A 10/2010
KR 20140040880 A 4/2014
KR 20140042230 A 4/2014

(56) References Cited

FOREIGN PATENT DOCUMENTS

| | | | |
|---|---|---|---|
| WO | 9213684 | A2 | 8/1992 |
| WO | 9404106 | A1 | 3/1994 |
| WO | 9708804 | A1 | 3/1997 |
| WO | 2010068070 | A2 | 6/2010 |
| WO | 2013070995 | A1 | 5/2013 |
| WO | 2015108805 | A1 | 7/2015 |
| WO | 2015108806 | A1 | 7/2015 |
| WO | 2015108801 | A4 | 9/2015 |

OTHER PUBLICATIONS

PCT International Search Report with Written Opinion in corresponding international application PCT/US2018/013236 dated Apr. 13, 2018.
All Office Actions, U.S. Appl. No. 12/186,715.
All Office Actions, U.S. Appl. No. 14/540,067.
All Office Actions, U.S. Appl. No. 14/540,300.
All Office Actions, U.S. Appl. No. 14/546,079.
All Office Actions, U.S. Appl. No. 14/552,554.
All Office Actions, U.S. Appl. No. 14/552,836.
All Office Actions, U.S. Appl. No. 14/552,851.
All Office Actions, U.S. Appl. No. 14/552,879.
All Office Actions, U.S. Appl. No. 15/171,020.
All Office Actions, U.S. Appl. No. 15/189,289.
All Office Actions, U.S. Appl. No. 15/354,197.
All Office Actions, U.S. Appl. No. 15/354,283.
All Office Actions, U.S. Appl. No. 15/471,080.
All Office Actions, U.S. Appl. No. 15/626,299.
All Office Actions, U.S. Appl. No. 15/666,755.
All Office Actions, U.S. Appl. No. 15/666,915.
All Office Actions, U.S. Appl. No. 15/866,580.
All Office Actions, U.S. Appl. No. 15/866,596.
All Office Actions, U.S. Appl. No. 16/357,525.
All Office Actions, U.S. Appl. No. 16/367,318.
All Office Actions, U.S. Appl. No. 16/367,338.
All Office Actions, U.S. Appl. No. 16/367,402.
All Office Actions, U.S. Appl. No. 16/838,060.
All Office Actions, U.S. Appl. No. 16/367,767.
https://en.wikipedia.org/wiki/Yield_(engineering)#:-:text=The%20yield%20strength%20or%20yield,material%20begins%20to%20deform%20plastically. (Year: 2020).
https://www.merriam-webster.com/dictionary/handle (Year: 2020).

* cited by examiner

HEATING DELIVERY ELEMENT FOR A SHAVING RAZOR

FIELD OF THE INVENTION

The present invention relates to shaving razors and more particularly to heated razors for wet shaving.

BACKGROUND OF THE INVENTION

Users of wet-shave razors generally appreciate a feeling of warmth against their skin during shaving. The warmth feels good, resulting in a more comfortable shaving experience. Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery. Razor blades within a razor cartridge have also been heated. The drawback with heated blades is they have minimal surface area in contact with the user's skin. This minimal skin contact area provides a relatively inefficient mechanism for heating the user's skin during shaving. However, the delivery of more heat to the skin generates safety concerns (e.g., burning or discomfort).

Accordingly, there is a need to provide a shaving razor capable of delivering efficient, safe and reliable heating that is noticeable to the consumer during a shaving stroke.

SUMMARY OF THE INVENTION

The invention features, in general, a simple, efficient heat delivery element for a shaving razor with a face plate having a skin contacting surface and an opposing inner surface. A heater having a heater track is positioned between an upper dielectric layer and a lower dielectric layer. A heat dispersion layer having a lower surface directly contacts the inner surface of the face plate. An upper surface of the heat dispersion layer directly contacts the lower dielectric layer of the heater.

In other embodiments, the invention features, in general, a simple, efficient heat delivery element for a shaving razor with a heater having a heater track positioned between an upper dielectric layer and a lower dielectric layer. The heater track is secured between the upper dielectric layer and the lower dielectric layer by an adhesive layer bonded to the upper dielectric layer and the lower dielectric layer.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
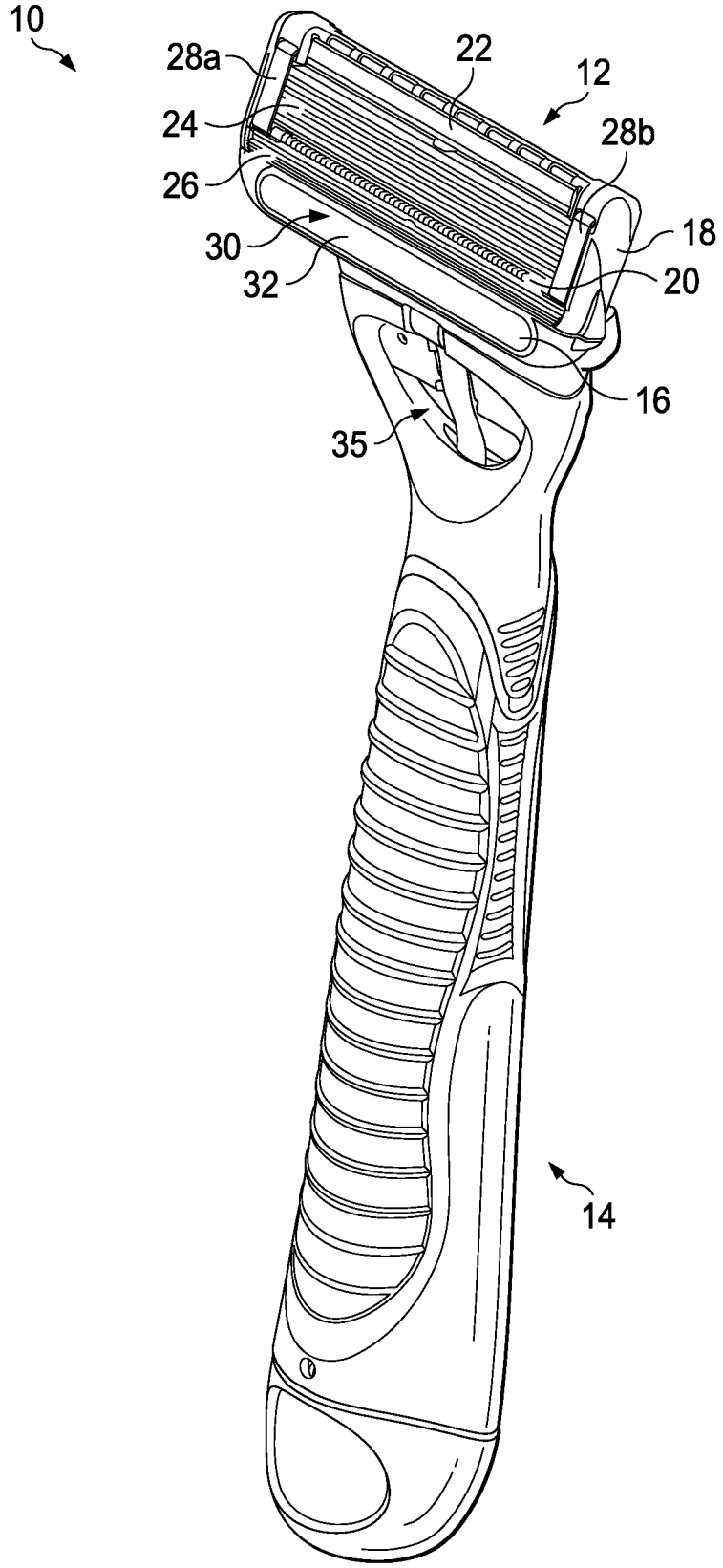
FIG. 1 is a perspective view of one possible embodiment of a shaving razor system.

Referring to FIG. 1, one possible embodiment of the present disclosure is shown illustrating a shaving razor system 10. In certain embodiments, the shaving razor system 10 may include a shaving razor cartridge 12 mounted to a handle 14. The shaving razor cartridge 12 may be fixedly or pivotably mounted to the handle 14 depending on the overall desired cost and performance. The handle 14 may hold a power source, such as one or more batteries (not shown) that supply power to a heat delivery element 16. In certain embodiments, the heat delivery element 16 may comprise a metal, such as aluminum or steel.

The shaving razor cartridge 12 may be permanently attached or removably mounted from the handle 14, thus allowing the shaving razor cartridge 12 to be replaced. The shaving razor cartridge 12 may have a housing 18 with a guard 20, a cap 22, and one or more blades 24 mounted to the housing 18 between the cap 22 and the guard 20. The guard 20 may be toward a front portion of the housing 18 and the cap 22 may be toward a rear portion of the housing 18 (i.e., the guard 20 is in front of the blades 24 and the cap is behind the blades 24). The guard 20 and the cap 22 may define a shaving plane that is tangent to the guard 20 and the cap 22. The guard 20 may be a solid or segmented bar that extends generally parallel to the blades 24. In certain embodiments, the heat delivery element 16 may be positioned in front of the guard 20.

In certain embodiments, the guard 20 may comprise a skin-engaging member 26 (e.g., a plurality of fins) in front of the blades 24 for stretching the skin during a shaving stroke. In certain embodiments, the skin-engaging member 24 may be insert injection molded or co-injection molded to the housing 18. However, other known assembly methods may also be used such as adhesives, ultrasonic welding, or mechanical fasteners.

The skin engaging member 26 may be molded from a softer material (i.e., lower durometer hardness) than the housing 18. For example, the skin engaging member 26 may have a Shore A hardness of about 20, 30, or 40 to about 50, 60, or 70. The skin engaging member 26 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, skin engaging member 26 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving. A softer material may also aid in masking the less pleasant feel of the harder material of the housing 18 and/or the fins against the skin of the user during shaving.

In certain embodiments, the blades 24 may be mounted to the housing 18 and secured by one or more clips 28*a* and 28*b*. Other assembly methods known to those skilled in the art may also be used to secure and/or mount the blades 24 to the housing 18 including, but not limited to, wire wrapping, cold forming, hot staking, insert molding, ultrasonic welding, and adhesives. The clips 28*a* and 28*b* may comprise a metal, such as aluminum for conducting heat and acting as a sacrificial anode to help prevent corrosion of the blades 24. Although five blades 24 are shown, the housing 18 may have more or fewer blades depending on the desired performance and cost of the shaving razor cartridge 12.

The cap 22 may be a separate molded (e.g., a shaving aid filled reservoir) or extruded component (e.g., an extruded lubrication strip) that is mounted to the housing 18. In certain embodiments, the cap 22 may be a plastic or metal bar to support the skin and define the shaving plane. The cap 22 may be molded or extruded from the same material as the housing 18 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Suitable skin lubricating water-soluble polymers may include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides may have molecular weights of about 100,000 to 6 million, for example, about 300,000 to 5 million. The polyethylene oxide may comprise a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

The heat delivery element 16 may include a face plate 30 for delivering heat to the skin's surface during a shaving stroke for an improved shaving experience. In certain embodiments, the face plate 30 may have an outer skin contacting surface 32 comprising a hard coating (that is harder than the material of the face plate 30), such as titanium nitride to improve durability and scratch resistance of the face plate 30. Similarly, if the face plate 30 is manufactured from aluminum, the face plate 30 may go through an anodizing process. The hard coating of the skin contact surface may also be used to change or enhance the color of the skin contacting surface 32 of the face plate 30. The heat delivery element 16 may be mounted to either the shaving razor cartridge 12 or to a portion of the handle 14. As will be described in greater detail below, the heat delivery element 16 may be mounted to the housing 18 and in communication with the power source (not shown).

Figure 2:
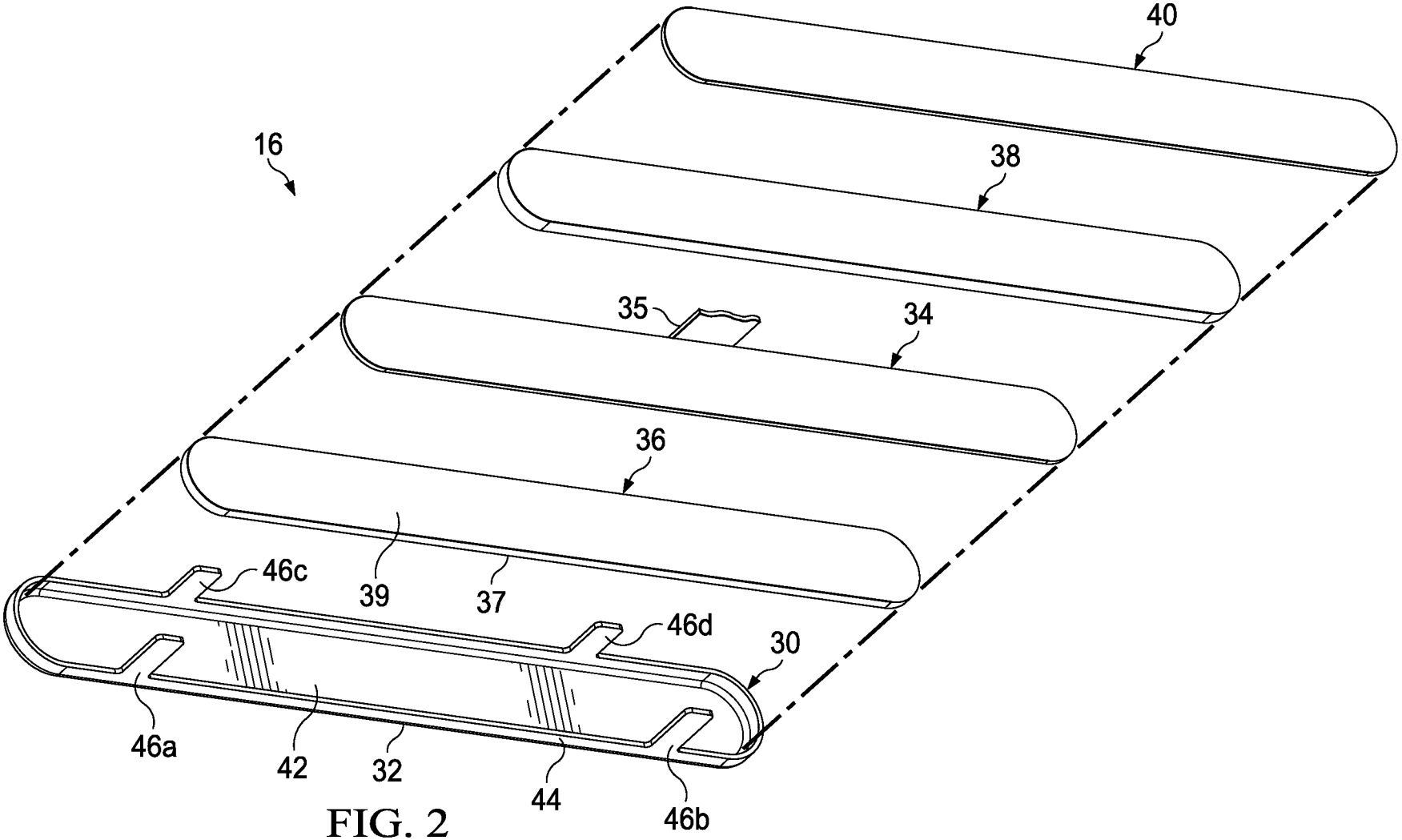
FIG. 2 is an assembly view of one possible embodiment of a heat delivery element that may be incorporated into the shaving razor system of FIG. 1.

Referring to FIG. 2, one possible embodiment of the heat delivery element 16 is shown that may be incorporated into the shaving razor system 10 of FIG. 1. The face plate 30 may be as thin as possible, but stable mechanically. For example, the face plate 30 may have a wall thickness of about 100 micrometers to about 200 micrometers. The face plate 30 may comprise a material having a thermal conductivity of about 10 to 30 W/mK, such as steel. The face plate 30 being manufactured from a thin piece of steel results in the face plate 30 having a low thermal conductivity thus helping minimize heat loss through a perimeter wall 44 and maximizes heat flow towards the skin contacting surface 32. Although a thinner piece of steel is preferred for the above reasons, the face plate 30 may be constructed from a thicker piece of aluminum having a thermal conductivity ranging from about 160 to 200 W/mK. The heat delivery element 16 may include a heater (not shown) having a bridge 35 that is in electrical contact with micro-controller and a power source (not shown), e.g. a rechargeable battery, positioned within the handle 14.

The heat delivery element 16 may include the face plate 30, the heater 34, a heat dispersion layer 36, a compressible thermal insulation layer 38, and a back cover 40. The face plate 30 may have a recessed inner surface 42 opposite the skin contacting surface 32 (see FIG. 1) configured to receive the heater 34, the heat dispersion layer 36 and the compressible thermal insulation layer 38. The perimeter wall 44 may define the inner surface 42. The perimeter wall 44 may have one or more legs 46*a*, 46*b*, 46*c* and 46*d* extending from the perimeter wall 44, transverse to and away from the inner surface 42. For example, FIG. 2 illustrates four legs 46*a*, 46*b*, 46*c* and 46*d* extending from the perimeter wall 44. As will be explained in greater detail below, the heater 34 may include heater tracks and electrical tracks, not shown.

The heat dispersion layer 36 may be positioned on and in direct contact with the inner surface 42 of the face plate 30. The heat dispersion layer 36 may have a lower surface 37 directly contacting the inner surface 42 of the face plate 30 and an upper surface 39 (opposite lower surface 37) directly contacting the heater 34 (for example, the lower dielectric layer shown in FIGS. 3 and 4). The heat dispersion layer 36 is defined as a layer of material having a high thermal conductivity, and is compressible. For example, the heat dispersion layer 36 may comprise graphite foil. Potential advantages of the heat dispersion layer 36 include improving lateral heat flow (spreading the heat delivery from the heater 34 across the inner surface 42 of the face plate 30, which is transferred to the skin contacting surface 32) resulting in more even heat distribution and minimization of hot and cold spots. The heat dispersion layer 36 may have an anisotropic coefficient of thermal conductivity in the plane parallel to the face plate 30 of about 200 to about 1700 W/mK (preferably 400 to 700 W/mK) and vertical to the face plate 30 of about 10 to 50 W/mK and preferably 15 to 25 W/mK to facilitate sufficient heat conduction or transfer. In addition, the compressibility of the heat dispersion layer 36 allows the heat dispersion layer 36 adapt to non-uniform surfaces of the inner surface 42 of the face plate 30 and non-uniform surfaces of the heater 34, thus providing better contact and heat transfer. The compressibility of the heat dispersion layer 36 also minimizes stray particulates from pushing into the heater 34 (because the heat dispersion layer 36 may be softer than the heater), thus preventing damage to the heater 34. In certain embodiments, the heat dispersion layer 36 may comprise a graphite foil that is compressed by about 20% to about 50% of its original thickness. For example, the heat dispersion layer 36 may have a compressed thickness of about 50 micrometers to about 300 micrometers more preferably 80 to 200 micrometers.

The heater 34 may be positioned between two compressible layers. For example, the heater 34 may be positioned between the heat dispersion layer 36 and the compressible thermal insulation layer 38. The two compressible layers may facilitate clamping the heater 34 in place without damaging the heater 34, thus improving securement and assembly of the heat delivery element 16. The compressible thermal insulation layer 38 may help direct the heat flow toward the face plate 30 and away from the back cover 40. Accordingly, less heat is wasted and more heat may be able to reach the skin during shaving. The compressible thermal insulation layer 38 may have low thermal conductivity, for example, less than 0.30 W/mK and preferably less than 0.1 W/mK. In certain embodiments, the compressible thermal insulation layer 38 may comprise an open cell or closed cellular compressible foam. The compressible thermal insulation layer 38 may be compressed 20-50% from its original thickness. For example, the compressible thermal insulation layer 38 may have a compressed thickness of about 400 μm to about 800 μm.

The back cover 40 may be mounted on top of the compressible thermal insulation layer 38 and secured to the face plate 30. Accordingly, the heater 34, the heat dispersion layer 36 and the compressible thermal insulation layer 38 may be pressed together between the face plate 30 and the back cover 40. The heat dispersion layer 36, the heater 34, and the compressible thermal insulation layer 38 may fit snugly within the perimeter wall 44. The pressing of the various layers together may result in more efficient heat transfer across the interfaces of the different layers in the heat delivery element 16. In absence of this compression force the thermal transfer across the interfaces is insufficient. Furthermore, the pressing of the layers together may also eliminate secondary assembly processes, such as the use of adhesives between the various layers. The compressible thermal insulation layer 38 may fit snugly within the perimeter wall 44.

Figure 3:
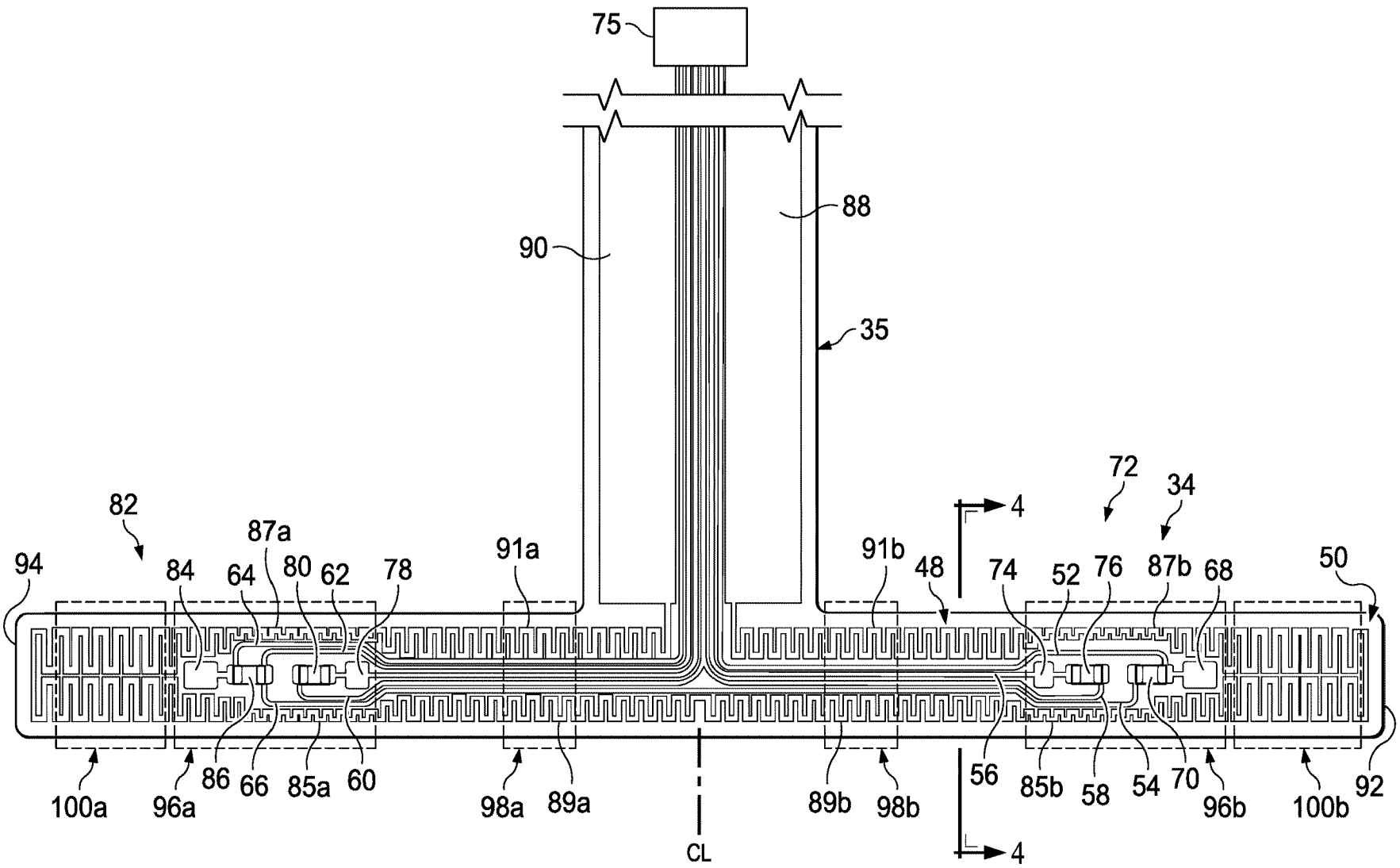
FIG. 3 is a top view of one possible embodiment of a heater that may be incorporated into the heat delivery element of FIG. 2.

Referring to FIG. 3, a top view of the heater 34 is shown. The heater 34 may have a heater track 48 laid over a lower dielectric layer 50. One or more electrical tracks 52, 54, 56, 58, 60, 62, 64 and 66 may also be laid over the lower dielectric layer 50 such that they are all spaced apart from the heater track 48. The one or more electrical tracks 52, 54, 56, 58, 60, 62, 64 and 66 may be positioned within a loop (e.g., perimeter) formed by the heater track 48. The electrical tracks 52, 54, 56, 58, 60, 62, 64 and 66 may connect a plurality of thermal sensors 70, 76, 80 and 86 to a micro controller 75. The microcontroller may process information from the thermal sensors 70, 76, 80 and 86 and adjust power to the heater track 48 to regulate temperature accordingly. The thermal sensor 70 may be thermally connected to a sensor pad 68. Similarly, the thermal sensor 76 may be thermally connected to a sensor pad 74. The thermal sensors 70 and 76 and respective sensor pads 68 and 74 may facilitate temperature control on one side of the heater 34. A thermal sensor pad 84 may be thermally connected to the thermal sensor 86. Similarly, a sensor pad 78 may be thermally connected to the thermal sensor 80. The thermal sensors 80 and 86 and respective sensor pads 78 and 84 may facilitate temperature control on another side of the heater 34. The thermal sensors 70 and 76 may be positioned laterally between the sensor pads 68 and 74. The thermal sensors 80 and 86 may be positioned laterally between the sensor pads 78 and 84. The spacing of the thermal sensors 70, 76, 80 and 86 and the sensor pads 68, 74, 78 and 84 may optimize spacing for more efficient heating of the heater 34.

One or more of the thermal sensors 70, 76, 80 and 86 may be independently connected to the circuit board 75 to provide for redundant safety measure if one or more of the thermal sensors 70, 76, 80 and 86 has a failure. At least one of the thermal sensors 70, 76, 80 and 86 may be spaced apart from the heater track 48 by a distance of about 0.05 mm to about 0.10 mm, which may help prevent direct heating of the thermal sensors 70, 76, 80 and 86 from the heater tracks. In addition, the sensor pads 68, 74, 78 and 84 may also be spaced apart from the heater track 48 to provide an accurate temperature reading of the graphite foil layer shown in FIG. 2. The sensor pads 68, 74, 78 and 84 may improve thermal connection to graphite foil layer to measure temperature quickly and accurately. The sensor pads 68, 74, 78 and 84 may be spaced apart from a lateral edge 92 and 94 of the dielectric layer 50. For example, the sensor pads may be spaced apart from a center line "CL" of the dielectric layer by about 10-30% and from the closest lateral edge 92 and 94 of the dielectric layer 50 by about 10-30%. The spacing and positioning of the sensor pads 68, 74, 78 and 84 may facilitate accurate temperature reading by the thermal sensors 70, 76, 80 and 86. The sensor pads may comprise a layer of copper. In certain embodiments, the sensor pads 68, 74, 78 and 84 may each have a minimum surface area greater than 0.3 $mm^2$, for example, about 0.3 $mm^2$ to about 0.45 $mm^2$. If the surface area of one or more of the sensor pads 68, 74, 78 and 84 is too small, the thermal sensors 70, 76, 80 and 86 may not be able to read small fluctuations in temperature and/or the response time may be longer.

The heater 34 may include a feeder track 88 and 90 that are part of the bridge 35 and connect the micro-controller to the heater track 48. A width of the feeder tracks 88 and 90 may be more than 5 times a maximum width of the heater track 48 positioned within the faceplate 30 of FIG. 2. The large width of the feeder tracks 88 and 90 supplies energy to the heater track 48 and helps prevent the bridge 35 from becoming too hot to the touch by minimizing the electrical resistance and hence the amount of heat generated. The bridge 35 may be exposed to the consumer during shaving in order to facilitate pivoting of the shaving razor cartridge 12 (see FIG. 1). Accordingly, if the bridge 35 becomes too hot, a consumer may be accidentally burned. Furthermore, the bridge 35 may not be insulated to prevent heat loss. Thus, it may be advantageous for the bridge 35 to generate as little heat as possible.

The lower dielectric layer 50 may comprise polyimide or polytetrafluoroethylene, polyvinylchloride, polyester, or polyethylene terephthalate. The heater track 48 may include copper tracks having a meander pattern forming a loop along a perimeter of the lower dielectric layer 50. The heater track 48 may have varying widths. For example, the heater track 48 may have a width of about 0.05 mm to about 0.09 mm in a first area 96*a* and 96*b* of the heater 34 and a width of about 0.07 mm to about 0.12 mm in a second area 98*a* and 98*b* of the heater 34. In certain embodiments, the heater track 48 may have a third area 100*a* and 100*b* having a width of about 0.10 mm to about 0.2 mm. Space may be limited on the lower dielectric layer 50 due to the electrical tracks 52, 54, 56, 58, 60, 62, 64 and 66, the sensor pads 68, 74, 78 and 84 and the thermal sensors 70, 76, 80 and 84. Accordingly, the heat generation should be maximized and uniform as possible. In certain embodiments, the layout of the heater track 48 may be symmetrical. For example, the heater track 48 may have the same layout on a first side 72 of the centerline "CL" as on a second side 82 of the centerline "CL".

The varying width of the heater track 48 allows for lower resistance in areas with more space and higher resistance in area of little space to achieve more uniform heat generation. Accordingly, more an equivalent amount of heat may be generated by the heater track 48 in a smaller space, for example in the first area 96*a* and 96*b*, compared to a larger space, for example, in the second area 98*a* and 98*b*. The second area 98*a* and 98*b* may be positioned toward a center line "CL" of the heater 34. The first area 96*a* may be associated with the thermal sensors 80 and 86 and/or sensor pads 78 and 84 toward one end 94 of the dielectric layer 50. Similarly, the first area 96*b* may be associated with the thermal sensors 70 and 76 and/or sensor pads 68 and 74 on an opposing end of the dielectric layer 50. For example, the sensor pads 78 and 84 and/or the thermal sensors 80 and 86 may be positioned between a pair of lengths 85*a* and 87*a* of the heater track 48 having a smaller width than a width for a length 89*a* and 91*a* of the heater track 48 located in the second area 98*a*. The second area 98*a* and 98*b* may have only the electrical tracks positioned between the length 89*a* and 91*a* of the heater track 48 (e.g., no sensors or sensor pads).

The first area 96*b* may be associated with the thermal sensors 70 and 76 and/or sensor pads 68 and 74 toward one end 92 of the dielectric layer 50. Similarly, the first area 96*b* may be associated with the thermal sensors 70 and 76 and/or sensor pads 68 and 74 on an opposing end of the dielectric layer 50. For example, the sensor pads 68 and 74 and/or the thermal sensors 70 and 76 may be positioned between a pair of lengths 85*b* and 87*b* of the heater track 48 having a smaller width than a width for a length 89*b* and 91*b* of the heater track 48 located in the second area 98*b*. The second area 98*a* and 98*b* on each side of the heater 34 may not have any sensor pads or thermal sensors positioned between the lengths of the heater track 48. For example, in the second area 98*b*, only the electrical tracks 52, 54, 56, 58, 60, 62, 64 and 66 may positioned between the length 89*b* and 91*b* of the heater track 48.

A third area 100*a* and 100*b* may be located toward a lateral edge 92 and 94 of the dielectric layer 50. For example, the third area 100*a* may be positioned between the thermal sensor 86 and the lateral edge 94. Similarly, the third area 100*b* may be positioned on the other side of the dielectric layer 50, between the thermal sensor 70 and the lateral edge 92. The third area 100*a* and 100*b* may lack thermal sensors, thermal pads, and electrical tracks. Accordingly, the heater track 48 in the third area 100*a* and 100*b* may have the widest section of the heater track 48 because the space is not limited by other electrical components. The layout of the first area 96*a* and 96*b*, the second area 98*a* and 98*b* and the third area 100*a* and 100*b* allow for more uniform distribution of heat by having varying widths to account for space that may be needed by other electrical components.

In certain embodiments, the heater track 48 may have a total resistance of about 1.5 to about 3 Ohms. The heater track 48 may have a meander pattern forming a loop along a perimeter of the lower polyamide layer 50. For example, the heater track 48 may extend around the electrical tracks (i.e., the electrical tracks are positioned within a loop formed by the heater track 48), the thermal sensors and the sensor pads. The meander pattern forming a perimeter or loop and the lower resistance in the area of the thermal sensors 70, 76, 80, 86 and the sensor pads 68, 74, 78 and 84 may facilitate delivery of sufficient heat in the area of the sensors because the thermal sensors and sensor pads generate no heat. The meander pattern of the heater track 48 may have the form of a zigzag; veering to right and left alternately. In certain embodiments, meander pattern of the heater track 48 may have a line or course with abrupt substantially 90 degree turns (e.g., train wave or square wave shape), to provide even more heater track 48 within a given area of the heater 34.

Figure 4:
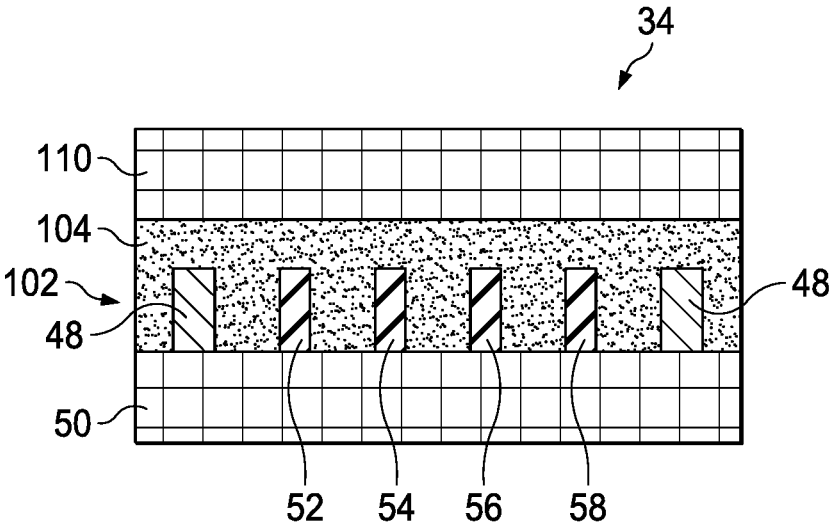
FIG. 4 is a cross section view of the heater, taken generally along line 4-4 of FIG. 3.

Referring to FIG. 4, a cross section view of the heater 34 is shown, taken generally along the line 4-4 of FIG. 3. The heater 34 may include the lower dielectric layer 50, a conductive layer 102 (that comprises the electrical tracks 52, 54, 56 and 58 and the heater track 48) an adhesive layer 104 and an upper dielectric layer 110. The conductive layer 102 may have a thickness of about 10 μm to about 40 μm (i.e., the electrical tracks 52, 54, 56, 58 and the heater tracks 48 have a thickness of about 10 μm to about 40 μm). The lower dielectric layer 50 may have a thickness of about 10 μm to about 30 μm. The upper dielectric layer 110 may have a thickness of about 10 μm to about 30 μm. The conductive layer 102 (comprising the electrical tracks 52, 54, 56 and 58 and the heater track 48) may be laid down on top of the lower dielectric layer 50. Since there are spaces between the electrical tracks 52, 54, 56 and 58 and the heater track 48, the adhesive layer 104 may flow between the electrical tracks 52, 54, 56 and 58 and the heater track 48 to improve integrity of the fragile conductive layer 102. The adhesive layer 104 may form a strong bond between the upper dielectric layer 110 and the lower dielectric layer 50. The adhesive layers 104 may also cover the conductive layer 102 (i.e., the heater track 48 and electrical tracks) creating a water proof seal. The various materials and thickness that make up the heater 34 allow it to bend under its own weight, thus making the heater 34 more malleable and less susceptible to breaking during handling and assembly. In addition, the heater 34 takes up less space due to its thin profile. In certain embodiments, the upper dielectric layer 110 and/or the adhesive layer 104 may be transparent. For example, the heater track 48 may be visible through the upper dielectric layer 110 and the adhesive layer 104, but may be colored, if desired.

The heater 34 may be sufficiently thin to provide flexibility and sufficient heat transfer. If the heater 34 (e.g., the lower dielectric layer 50) is too thick, poor heat transfer may result. The heater 34 may also provide sufficient mechanical stability to allow it to conform during assembly within the face plate 30 of FIG. 2. The lower dielectric layer may prevent electrical contact with other layers of the heat delivery element 16, but yet allow sufficient heat transfer. For example, the lower polyimide dielectric layer may prevent the heater track and the electrical tracks from directly contacting the graphite layer or the inner surface of the face plate 30.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A heat delivery element for a shaving razor comprising:

a face plate having a skin contacting surface and an opposing inner surface;

a heater having a heater track positioned between an upper dielectric layer and a lower dielectric layer; and a heat dispersion layer having a lower surface directly contacting the inner surface of the face plate and an upper surface directly contacting the lower dielectric layer of the heater wherein the heat dispersion layer comprises graphite foil that is compressed by 20% to 50% of an original thickness.

2. A heat delivery element of claim 1 wherein at least one of the upper dielectric layer and the lower dielectric layer comprises polyimide.

3. The heat delivery element of claim 1 wherein the heat dispersion layer has a compressed thickness of 50 to 300 micrometers.

4. The heat delivery element of claim 1 wherein the heat dispersion layer has a compressed thickness of 80 to 200 μm.

5. The heat delivery element of claim 1 wherein the heat dispersion layer has an anisotropic coefficient of thermal conductivity in a plane parallel to the face plate of 200 to 1700 W/mK and an anisotropic coefficient of thermal conductivity in a plane vertical to the face plate of 10 to 50 W/mK.

6. The heat delivery element of claim 1 further comprising a compressible thermal insulation layer positioned on one of the dielectric layers.

7. The heat delivery element of claim 6 wherein the compressible thermal insulation layer has a thermal conductivity less than 0.10 W/mk.

8. The heat delivery element of claim 6 wherein the compressible thermal insulation layer comprises a compressible foam.

9. The heat delivery element of claim 8 wherein the compressible thermal insulation layer is compressed 30 percent to 70 percent from an original thickness.

10. The heat delivery element of claim 8 wherein the compressible thermal insulation layer has a compressed thickness of 400 to 800 μm.

11. The heat delivery element of claim 1 further comprising a cover secured to the faceplate, wherein the heater and the heat dispersion layer are secured between the face plate and the cover.

12. The heat delivery element of claim 1 wherein the face plate comprises a recessed inner surface opposite the skin contacting surface configured to receive the heat dispersion layer and the heater.

13. The heat delivery element of claim 1 wherein the face plate has a thickness of 100 to 200 μm.

14. The heat delivery element of claim 1 wherein the face plate comprises a material having a thermal conductivity of 10 to 30 W/mk.

* * * * *